US007146951B2

(12) United States Patent
Sailer et al.

(10) Patent No.: US 7,146,951 B2
(45) Date of Patent: Dec. 12, 2006

(54) SWITCHABLE CAM FOLLOWER

(75) Inventors: Peter Sailer, Erlangen (DE); Oliver Schnell, Veitsbronn (DE); Jochen Tovar, Erlangen (DE)

(73) Assignee: Ina Schaeffler KG (DE)

( * ) Notice: Subject to any disclaimer, the term of this patent is extended or adjusted under 35 U.S.C. 154(b) by 0 days.

(21) Appl. No.: 11/210,049

(22) Filed: Aug. 22, 2005

(65) Prior Publication Data

US 2006/0042582 A1 Mar. 2, 2006

(30) Foreign Application Priority Data

Aug. 24, 2004 (DE) ..... 10 2004 040 808

(51) Int. Cl.
*F01L 1/18* (2006.01)

(52) U.S. Cl. ..... 123/90.45; 123/90.44; 123/90.52

(58) Field of Classification Search ..... 123/90.16, 123/90.45, 90.46, 90.48, 90.52, 90.59, 90.39, 123/90.44, 90.55
See application file for complete search history.

(56) References Cited

U.S. PATENT DOCUMENTS 6,606,972 B1 * 8/2003 Wenisch et al. ..... 123/90.17
6,945,204 B1 * 9/2005 Gecim et al. ..... 123/90.12

FOREIGN PATENT DOCUMENTS

| | | |
|---|---|---|
| DE | 42 11 631 | 4/1993 |
| DE | 44 42 965 | 6/1996 |
| DE | 196 04 866 | 8/1997 |
| DE | 198 04 952 | 8/1999 |
| DE | 198 38 926 | 3/2000 |
| DE | 198 44 202 A1 | 3/2000 |
| DE | 100 48 618 | 4/2002 |
| DE | 103 10 776 | 11/2003 |
| JP | 03151511 | 6/1991 |

* cited by examiner

*Primary Examiner*—Ching Chang
(74) *Attorney, Agent, or Firm*—Ostrolenk, Faber, Gerb & Soffen, LLP

(57) ABSTRACT

A switchable cam follower, comprising two relatively movable, e.g., telescopable, units which can be connected via a coupling which engages over a dividing face between the units such that there is a large valve stroke. It is possible to generate no valve stroke or a small valve stroke if the coupling does not engage. At least one spring, which can be loaded compressively or torsionally, acts as a lost motion spring between the units. A compression limiting device impedes movement of the lost motion spring to the blocked position. In an incorrect switching operation in which the coupled units move undesirably toward each other and in a sudden manner under the influence of a valve spring force, movement of the spring into the "blocked" position to become seated is prevented by the limiting device.

13 Claims, 2 Drawing Sheets

SWITCHABLE CAM FOLLOWER

This application is base on the German Patent Application No. 10 2004 040 808.4 filed on Aug. 24, 2004, and claims benefit under 35 U.S.C. 119(a).

FIELD OF THE INVENTION

The invention relates to a switchable cam follower or a switchable supporting element for a valve timing mechanism of an internal combustion engine, comprising two units which can move relative to one another and can be connected to one another via a coupling means which engages over a dividing face between the units, in such a way that there is a large valve stroke, while it is possible to generate no valve stroke or a small valve stroke if the coupling means does not engage, and at least one spring, such as a metal spring, which can be loaded compressively or torsionally acting as a lost motion spring between the units.

BACKGROUND OF THE INVENTION

A cam follower of the generic type, which is configured here as a switchable roller tappet, is described in DE 198 44 202 A1. If, for example, decoupling is to be brought about during a basic circular pass of the cams from the coupling state which is described in FIG. 2 of that DE publication, hydraulic medium is applied in front of the slide-like element as coupling means. In exceptional cases, which need not be explained in greater detail at this juncture, the coupling means may retract only to an insufficient degree (or may assume its coupling position only to an insufficient degree from the decoupled state), so that coupling thus still exists in the edge region. The above-mentioned undesirable coupling can be canceled abruptly during the following cam stroke. This means that the inner unit (pressure piston) moves in the hole direction of the outer unit (housing) in an extremely accelerated manner, with compression of the lost motion spring which is situated between them.

This leads to the lost motion spring moving completely into the blocked position. After a plurality of incorrect switching operations of this type, the lost motion spring becomes seated, causing the disadvantage of its diminished spring force. It can thus occur that the lost motion spring can no longer hold the housing on the receding cam flank during switching off and thus for lost motion.

OBJECT OF THE INVENTION

The invention therefore has an object of providing a cam follower or a switchable supporting element of the above-mentioned type, in which the stated disadvantages are eliminated.

SUMMARY OF THE INVENTION

This object is obtained according to the invention by the spring being assigned means for limiting its compression, which means are configured so that a blocked position of the spring is impeded.

The disadvantages cited in the introduction hereof are eliminated using simple means on account of the above-mentioned measures. This definitively prevents the spring becoming blocked in the above-mentioned incorrect switching operations. The means according to the invention can likewise be used to produce a general travel limitation means between the two units.

The scope of protection of the invention relates to any type of switchable cam followers or switchable supporting elements. Particular consideration is given to switchable roller tappets or mushroom head tappets, switchable supporting elements, switchable cup tappets and switchable valve rocker mechanisms and rocker arm mechanisms, in which at least one lost motion spring is applied.

One development of the invention proposes to optionally provide form-fitting stops, such as projections or shoulders which are in the shape of tubes or cylinders, elastic damping means or else a further spring such as a compression coil spring, between the units. In the latter case, the coil spring is configured such that it becomes blocked before occurrence of a blocked position of the lost motion spring.

The above-mentioned means for limiting the compression can be retrofitted simply to previously configured, switchable cam followers or switchable supporting elements, to thereby cause only a very small amount of subsequent structural expenditure. Optionally, the means can also be configured in a single-part form with one of the units.

At least one cylindrical or conical compression coil spring which is made of metal is suitable, in particular, as a lost motion spring. However, other spring types are also feasible, such as swivel pin springs (in switchable rocker drives) which can be assigned a stop. Moreover, the person skilled in the art will consider other mechanical spring types or other spring types for use as lost motion springs at this juncture.

Optionally, leakage gap means can also be used to limit compression of the lost motion spring.

Other features and advantages of the present invention will become apparent from the following description of the invention which refers to the accompanying drawings.

BRIEF DESCRIPTION OF THE DRAWINGS

The invention is expediently shown in greater detail using the drawing, in which.

DETAILED DESCRIPTION OF EMBODIMENTS OF THE INVENTION

The invention is explained in greater detail using as an example a roller tappet as a switchable cam follower 1.

Figure 1:
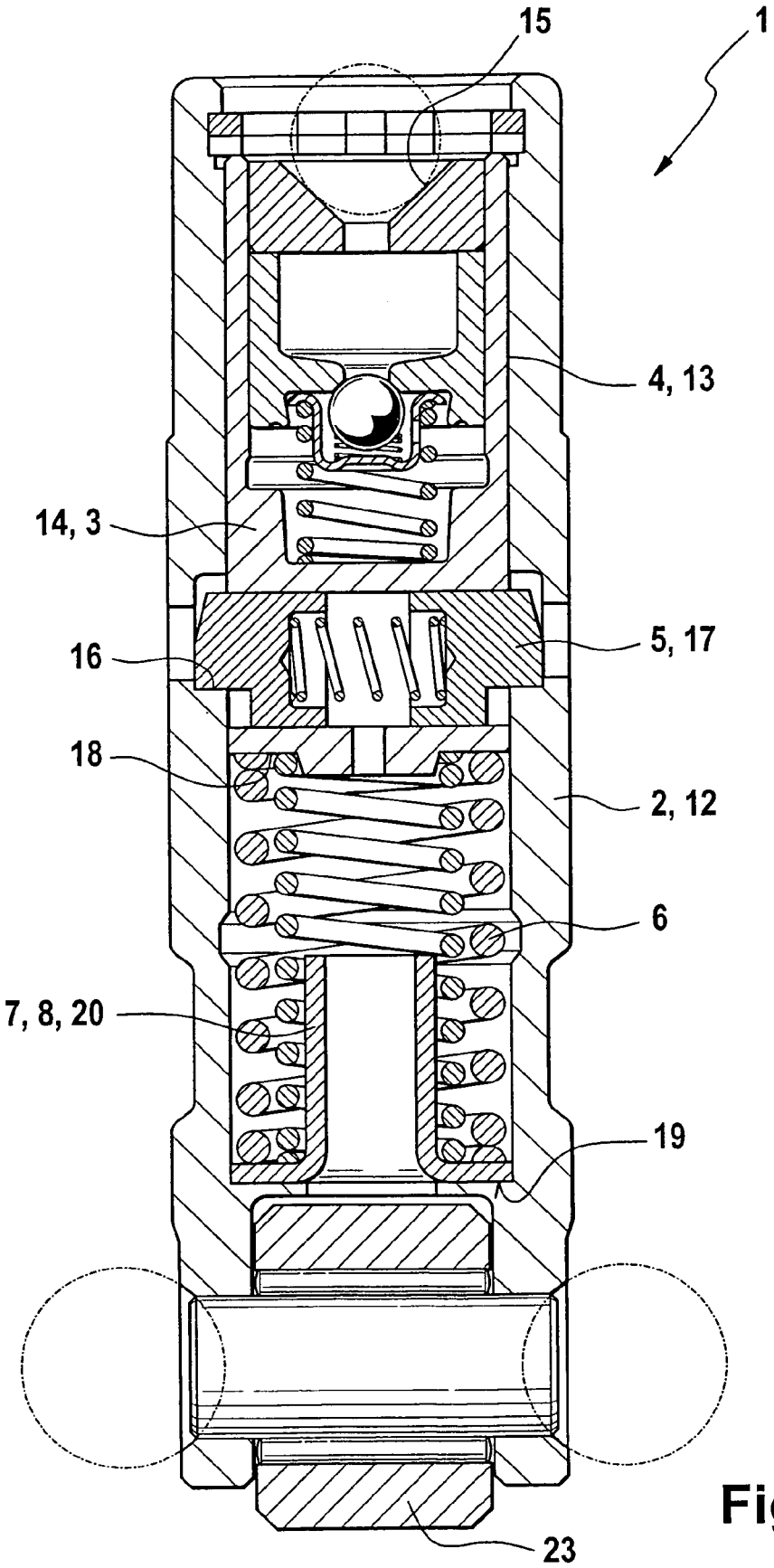
FIG. 1 shows a longitudinal section through a roller tappet as a switchable cam follower.

FIG. 1 discloses the switchable cam follower 1 for a valve timing mechanism of an internal combustion engine. That switchable cam follower 1 comprises an outer unit 2 which is a housing 12 here. A further unit 3, which is configured here as a pressure piston 14, runs in a hole 13 of the unit 2 in an axially movable manner with respect to the hole 13. It is located remote from the cam. On its side 15 which is remote from the cam, the unit 3 acts at least indirectly on a rocker arm (not shown). A roller 23 is applied on the housing 12 at the cam side. The roller 23 serves as the opposing element for a lifting cam (not shown).

Coupling means 5 can be displaced radially outwardly. Those means are configured here as pistons or slide-like elements 17 that extend across the pressure piston 14. In the coupled state of the elements 17 shown in FIG. 1 and in the further figures, the elements 17 extend into a recess 16, for example into an annular groove in the housing 12. A decoupling state of the elements 17 can be produced by hydraulic medium which is guided (by means not shown) that are ahead of the elements 17 on their respective end sides. As can be seen, in the stated coupling case, the elements 17 engage over a dividing face 4 between the pressure piston 14 and the housing 12.

As the person skilled in the art can gather from the figures, a spring 6 which can be loaded compressively extends between a cam-side end 18 (upper end in FIG. 1), of the pressure piston 14 and a base 19 of the hole 13 as a lost motion spring. The spring 6 is shown as a spring assembly.

In FIG. 1, a stop 8 is fastened to the base 19. The stop 8 comprises a tube-shaped projection 20, which extends in the direction toward the end 18 of the pressure piston 14. The stop 8 serves as one example of means 7 for limiting compression of the spring 6 as a lost motion spring.

As was described at the beginning of the description, incorrect switching operations can occur during operation of the cam follower 1. If the element 17 is extended or retracted only insufficiently, those incorrect switching operations can lead, in the event of a cam lift, to transmission of the cam stroke being canceled and the pressure piston 14 moving abruptly in the direction toward the base 19 of the housing 12 under the influence of the prestressed valve spring. This is accompanied by the spring 6 as a lost motion spring moving into the "blocked" position which is undesirable. After a plurality of incorrect switching operations, this leads to that spring 6 becoming seated, with the consequence that its spring force is reduced. The spring 6 can thereafter perform its lost motion function only to an unsatisfactory degree.

If an undesirable incorrect switching operation occurs, the end 18 of the pressure piston 14 would strike the projection 20, in the solution according to FIG. 1, before the spring 6 as a lost motion spring reaches its blocked position.

Figure 2:
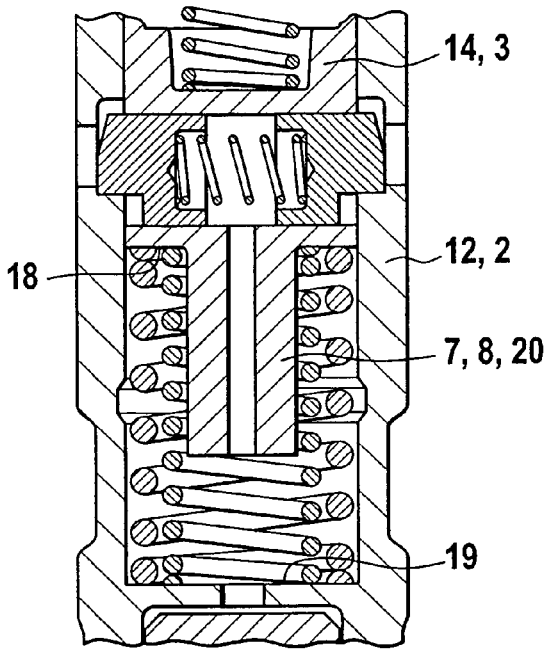
FIGS. 2 to 5 show partial sections through the above-mentioned cam follower in the region of the means for limiting the compression.

FIG. 2 discloses a similar embodiment to that in FIG. 1. However, in place of the projection 20 on the base 19, an optionally single-part projection 20 is applied here at the end 18 of the pressure piston 14, which projection 20 extends in the direction toward the base 19. The projection 20 is enclosed by the lost motion spring 6. During an incorrect switching operation, the projection 20 would find a stop on the base 19.

Figure 3:
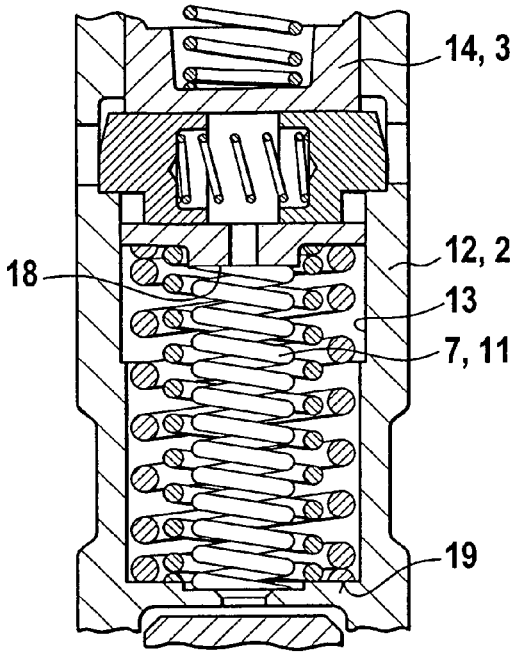

FIG. 3 discloses a further variant of the invention, in which at least one cylindrical compression coil spring 11 rather than a projection acts as the means 7 for limiting compression of the spring 6 as a lost motion spring. The compression coil spring 11 is configured in such a way that its blocked position starts before the blocked position of the spring 6.

Figure 4:
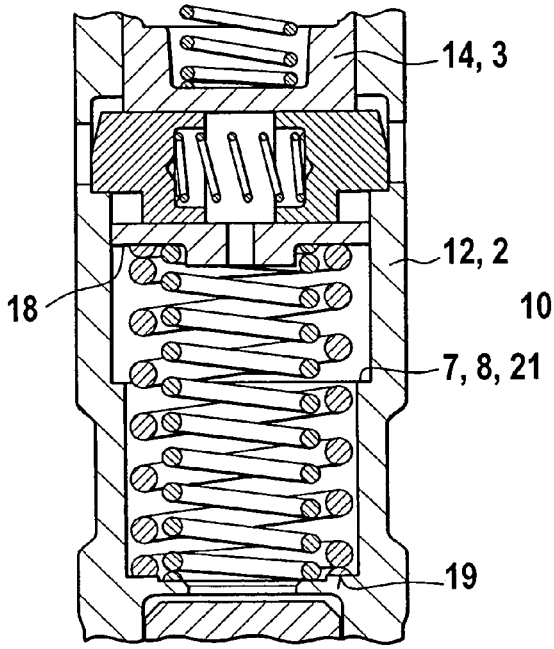

FIG. 4 once again shows a form-fitting stop 8, comprising an annular shoulder 21 of the hole 13 of the housing 12. During an incorrect switching operation, the end 18 of the pressure piston 14 would contact the annular shoulder 21.

Figure 5:
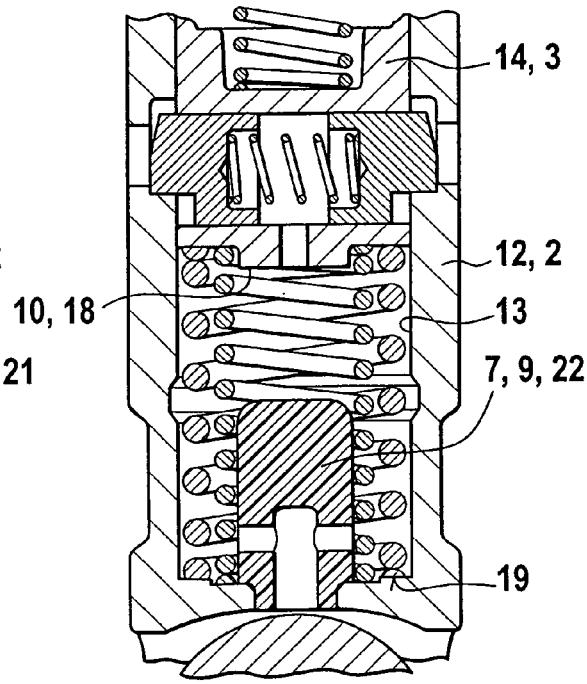

Finally, an elastic damping means 9 acting as the means 7 for limiting is shown in FIG. 5. The elastic damping means 9 is designed as a stop 22 which bulges outward on force being applied, is applied to the base 19 of the housing 12 and extends in the direction toward the end 18 of the pressure piston 14.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A switchable cam follower or a switchable supporting element for a valve timing mechanism of an internal combustion engine, comprising a first inner unit and a second outer unit which are movable telescopingly relative to one another, the units passing by each other during telescoping motion at a dividing face;

a coupling device operable to selectively connect the units to one another to block telescoping motion and to disconnect the units to permit their telescoping movement; the coupling device connects the units by engaging over the dividing face between the units, in such a way that there is a large valve stroke, while enabling generation of no valve stroke or of a small valve stroke if the coupling device does not engage the units;

at least one spring which can be loaded compressively or torsionally and operable as a lost motion spring between the telescopable units; and a compression limiting device in the cam follower or supporting element for limiting compression of the lost motion spring such that a blocked position of the lost motion spring is impeded, the compression limiting device being located in one of a group of locations consisting of:

(1) on an inner surface of the second outer unit; and (2) within an inner radius of the lost motion spring.

2. The cam follower or supporting element as claimed in claim 1, wherein the compression limiting device comprises a telescoping motion stop which acts between the units.

3. The cam follower or supporting element as claimed in claim 1, wherein the compression limiting device comprises an elastic damper which acts between the units, and a stop face for being engaged by the damper and disposed on one of the units.

4. The cam follower or supporting element as claimed in claim 3, wherein the elastic damper is fastened to the other of the units.

5. The cam follower or supporting element as claimed in claim 3, wherein the damper comprises a polymeric element which bulges inward or outward during its damping.

6. The cam follower or supporting element as claimed in claim 1, wherein the compression device comprises at least one cylindrical or conical compression coil spring which acts between the units, and the coil spring has a blocked position which is reached before the blocked position of the lost motion spring.

7. The cam follower as claimed in claim 6, wherein the compression limiting device comprises a telescoping motion stop which acts between the units; and the form-fitting stop extends on a cam-side end of the second unit or a base of the hole of second outer unit, the form-fitting stop is configured as a projection which is similar to a tube or cylinder, and the form-fitting stop extends axially in the direction toward the base or the cam-side end.

8. The cam follower as claimed in claim 6, wherein the compression limiting device comprises a stop against telescoping motion which acts between the units and wherein the stop extends in a hole of the first unit, the stop comprising an annular shoulder for a cam-side end of the first inner unit.

9. The cam follower or supporting element as claimed in claim 8, wherein the damper comprises a polymeric element which bulges inward or outward during its damping.

10. The cam follower as claimed in claim 6, wherein the compression limiting device comprises an elastic damper which acts between the units, and a stop face for being engaged by the damper and disposed on one of the units and the elastic damper extends as a stop comprising a buffer, tube or cylinder on a cam-side end of the second outer unit or a base of the hole in the first inner unit, and extends axially in the direction toward the base or the cam-side end.

11. The cam follower as claimed in claim 6, wherein the compression device comprises at least one cylindrical or conical compression coil spring which acts between the units, and the coil spring has a blocked position which is reached before the blocked position of the lost motion spring, and the at least one compression coil spring is clamped between a base of the hole of the second outer and a cam-side end of the first inner.

12. The cam follower as claimed in claim 6, wherein the lost motion spring is a cylindrical or conical compression coil spring which is installed between a base of the hole of the second outer and a cam-side end of the first inner.

13. The cam follower as claimed in claim 1, wherein the cam follower comprises a roller tappet or a mushroom head tappet which acts at least indirectly on a rocker arm;

the second outer unit comprises a housing having one end which is in contact with a lifting cam;

the first inner unit comprises a pressure piston running in a hole at another end of the housing, the pressure piston having a side which is remote from the cam and that communicates with the rocker arm and has at least one slide-like element as the coupling device and which during coupling is displaced radially outward into a recess in the second outer unit.

* * * * *